US005794382A

United States Patent [19]

Prucinsky

[11] Patent Number: 5,794,382

[45] Date of Patent: Aug. 18, 1998

[54] FIRE RATED REMOVABLE MULLION

[75] Inventor: Matthew S. Prucinsky, Indianapolis, Ind.

[73] Assignee: Von Duprin, Inc., Indianapolis, Ind.

[21] Appl. No.: 562,921

[22] Filed: Nov. 27, 1995

[51] Int. Cl.[6] ..... E06B 5/00

[52] U.S. Cl. ..... 49/365; 74/527; 49/8; 49/7

[58] Field of Search ..... 49/365, 506, 507, 49/1, 7, 8; 403/329, 194, 192; 74/527

[56] References Cited

U.S. PATENT DOCUMENTS

| | | | |
|---|---|---|---|
| 1,258,638 | 3/1918 | Tomkinson et al. | 49/365 X |
| 2,275,729 | 3/1942 | Casse | 49/365 X |
| 2,275,730 | 3/1942 | Casse | 49/365 X |
| 3,000,062 | 9/1961 | McCandless | 49/365 X |
| 3,319,382 | 5/1967 | Hand | 49/365 X |
| 4,327,523 | 5/1982 | Gravely | 49/365 X |
| 5,005,315 | 4/1991 | Jackson, Jr. | 49/365 X |
| 5,435,102 | 7/1995 | McCarthy | 49/365 X |
| 5,450,697 | 9/1995 | Prucinsky et al. | 49/365 X |
| 5,471,792 | 12/1995 | Higgins et al. | 49/365 |

FOREIGN PATENT DOCUMENTS

| | | | |
|---|---|---|---|
| 1482828 | 8/1977 | United Kingdom | 49/365 |

*Primary Examiner*—Anthony Knight
*Assistant Examiner*—Curtis Cohen
*Attorney, Agent, or Firm*—Robert F. Palermo; Michael H. Minns

[57] ABSTRACT

A fire-rated removable mullion, includes a top fitting mounted to a door frame lintel, a bottom fitting assembly, a mullion head capable of detachably engaging the top fitting, a mullion tube having provisions for mounting between the mullion head and the bottom fitting assembly, and another provision for accommodating thermal expansion of the mullion assembly to resist warping of the assembly. Where desired, a mortise cylinder lock can be included to limit removal by unauthorized persons.

11 Claims, 10 Drawing Sheets

FIRE RATED REMOVABLE MULLION

BACKGROUND OF THE INVENTION

This invention relates generally to removable mullions for doorways and more particularly to fire rated removable mullions having key operated latch bolts for installing them in and removing them from doorways.

Mullions are used in exit applications to provide single door performance in double door openings with rim type exit devices. A door strike is mounted on each side of the mullion which engage with latch bolts of rim latch devices to secure the doors. The mullions are attached between the top of the door frame and the floor or door sill using threaded fasteners which, upon repeated working shocks and vibrations, can become loose. After being removed and reinstalled a few times, the threads of the fasteners may become damaged, stripped, or worn due to improper alignment of the parts, cross-threading, and over-torquing or under-torquing; and the fasteners can work loose and allow the doors to rattle. Such rattling, in addition to being an annoyance, can also compromise the strength and security of the doors. Even when the fasteners are free of damage and are properly handled, removal and installation of mullions is a time consuming task which carries a risk of losing some of the parts. Thus, removable mullions require a high degree of care in handling in order to avoid the degradation of quality that accompanies damage such as described.

Fire-rated mullions must pass the Underwriters Laboratories (U.L.) 10B Fire Tests For Door Assemblies. This test consists of exposing a door assembly with a fire-rated mullion and fire doors to a fire at 1900 degrees Fahrenheit (F) for three hours, after which a fire hose is played on the doors for a few minutes. The doors must remain closed throughout all phases of the test.

Commonly used fire-rated mullions are very similar to standard mullions with the exception that a space is allowed for thermal expansion, to prevent buckling of the mullion and opening of the doors, in case of fire. This space aggravates the criticality of fastener tightening already described; because, by providing a gap between the mullion and its anchor points on the top and/or bottom frame members, it causes the mullion to depend solely on the fasteners to hold it securely in place.

The foregoing illustrates limitations known to exist in present removable mullions. Thus, it would be advantageous to provide an alternative directed to overcoming one or more of those limitations. Accordingly, a suitable alternative is provided including features more fully disclosed hereinafter.

SUMMARY OF THE INVENTION

In one aspect of the present invention, a fire-rated removable mullion assembly is provided, including a top fitting mounted to a door frame lintel, a bottom fitting assembly, a mullion head having means for detachably engaging said top fitting, a mullion tube having means for mounting between said mullion head and said bottom fitting assembly, and means for accommodating thermal expansion of said mullion assembly to resist warping of said assembly.

The foregoing and other aspects of the invention will become apparent from the following detailed description, when considered in conjunction with the accompanying drawings.

DETAILED DESCRIPTION

In describing the invention, reference will be made to the numbers, which are the same in all Figures for a given feature of the device. In the Figures, when a feature is clearly visible, it is usually numbered, even though it may not be discussed with other features shown in a particular Figure.

Figure 1:
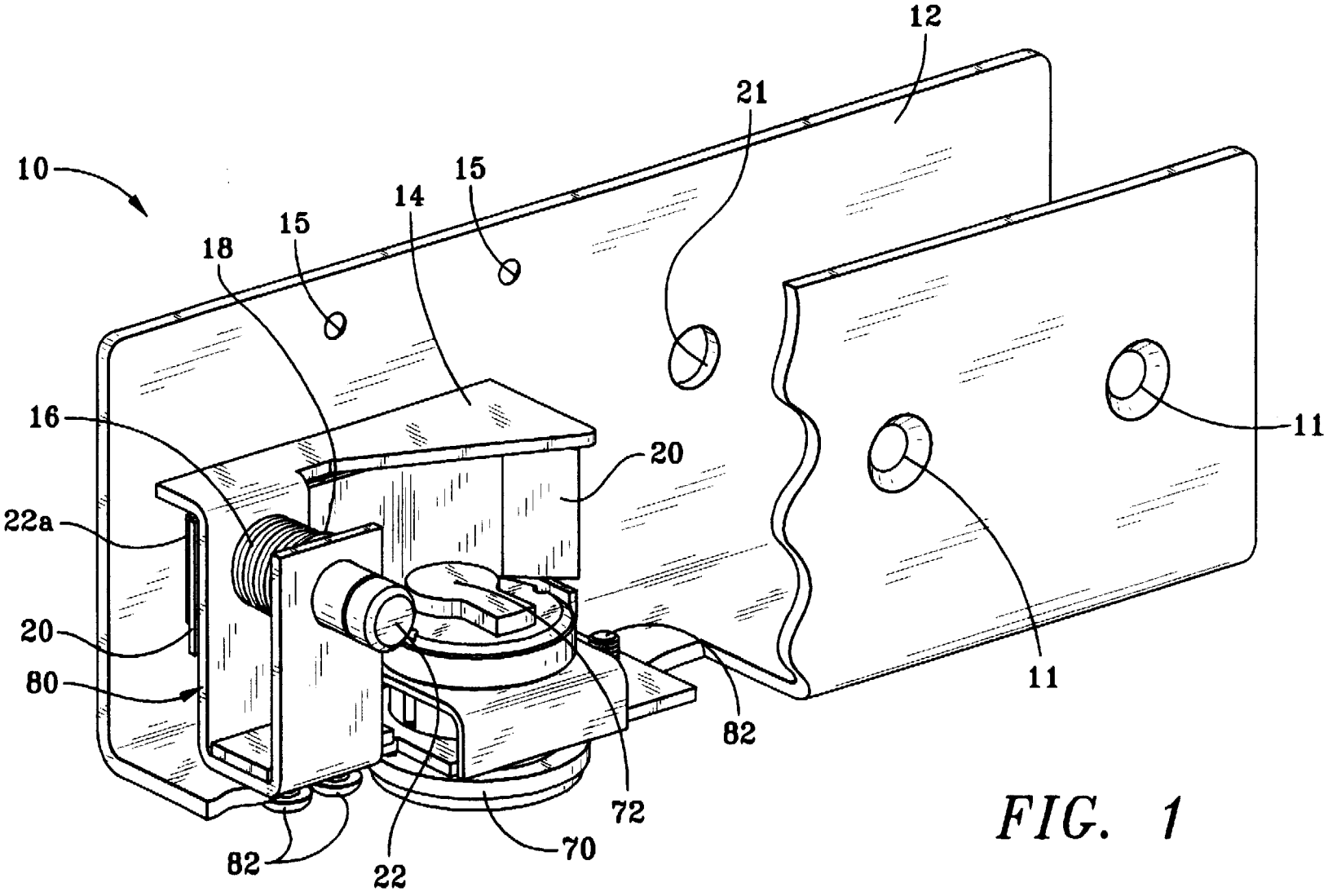
FIG. 1 is a schematic partially cutaway perspective view of a mullion head illustrating details of the locking bolt assembly.

FIG. 1 shows a mullion head 10 comprising a channel shaped outer mullion 12 which has holes 11 (preferably countersunk) on one side, plain holes 21 opposite holes 11, and holes 15 on both sides (one side not seen because of the broken-away view). A locking bolt assembly 80 is installed in the mullion head with fasteners 82 and may include a mortise key cylinder 70. The locking bolt assembly 80 consists of the bracket 14, the compression spring 16 surrounding the bolt 22 and fastened to the bolt by a retaining ring 18 in order to bias the bolt 22 in the extended position. The locking bolt lever 20 has a clearance hole (not shown) around the bolt 22, between the bracket 14 and a bolt foot (not shown) fixed to the end of the bolt 22. Lever 20 engages the bolt foot behind the bracket 14 and provides the mechanical advantage for fully withdrawing the bolt 22 when the key cylinder 70 is operated. The key cylinder cam 72 pushes the bolt lever 20 to withdraw the bolt 22 and compress the spring 16.

Figure 2:
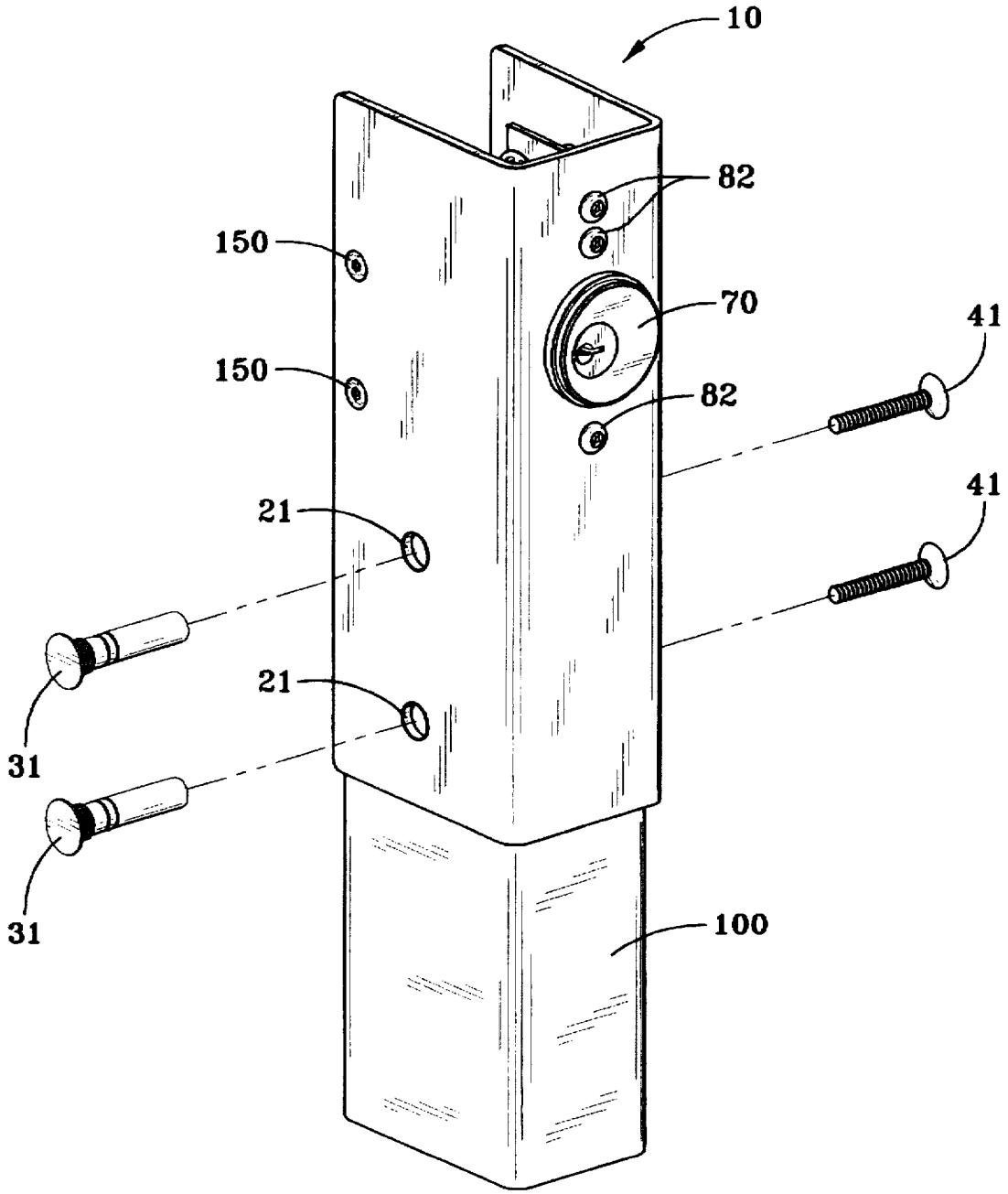
FIG. 2 is a schematic perspective view showing the mullion head and its attachment to the mullion tube.

FIG. 2 shows a mullion head 10 in position for installation on mullion tube 100. Preferably sex bolts 31 are inserted in holes 21 and pressed in so that the knurled surface under the heads engages the perimeter of the holes 21 and holds the bolts so that screws 41 can be threaded into the bolts 31. The sex bolts are preferred because they simplify alignment and installation, but ordinary bolts and nuts or bolts threaded into pre-threaded holes in the mullion tube 100 could be used as well. In this view the fasteners 82, which hold the locking bolt assembly 80 in the mullion head 10, are seen as are fasteners 150, which hold the rear cover plate (15 in FIG. 7) on the mullion head 10.

Figure 3:
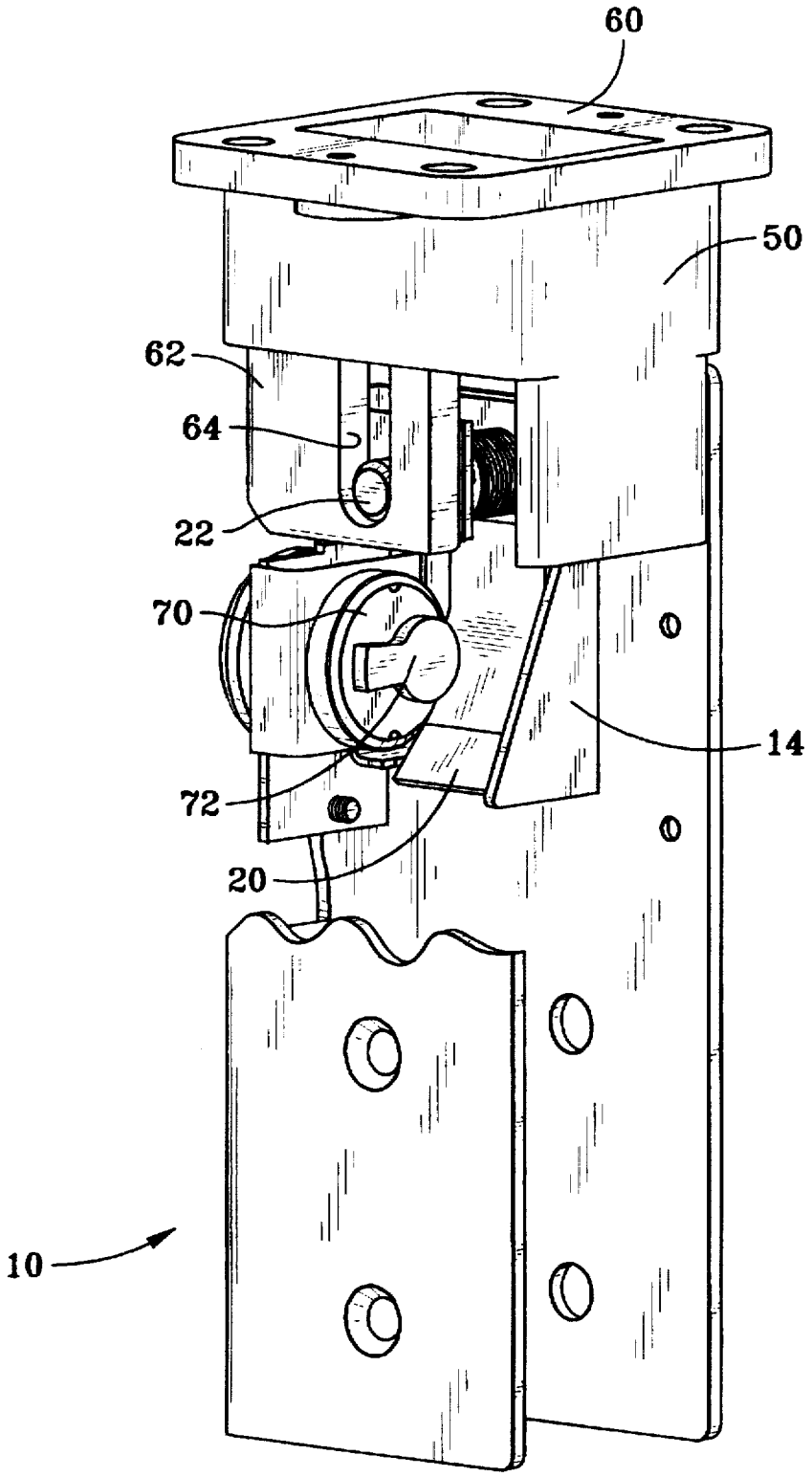
FIG. 3 is a schematic partially cutaway perspective view showing the mullion head, the fusible spacer, the locking bolt engagement with the top fitting, and the mortise key cylinder in the locked position.
Figure 7:
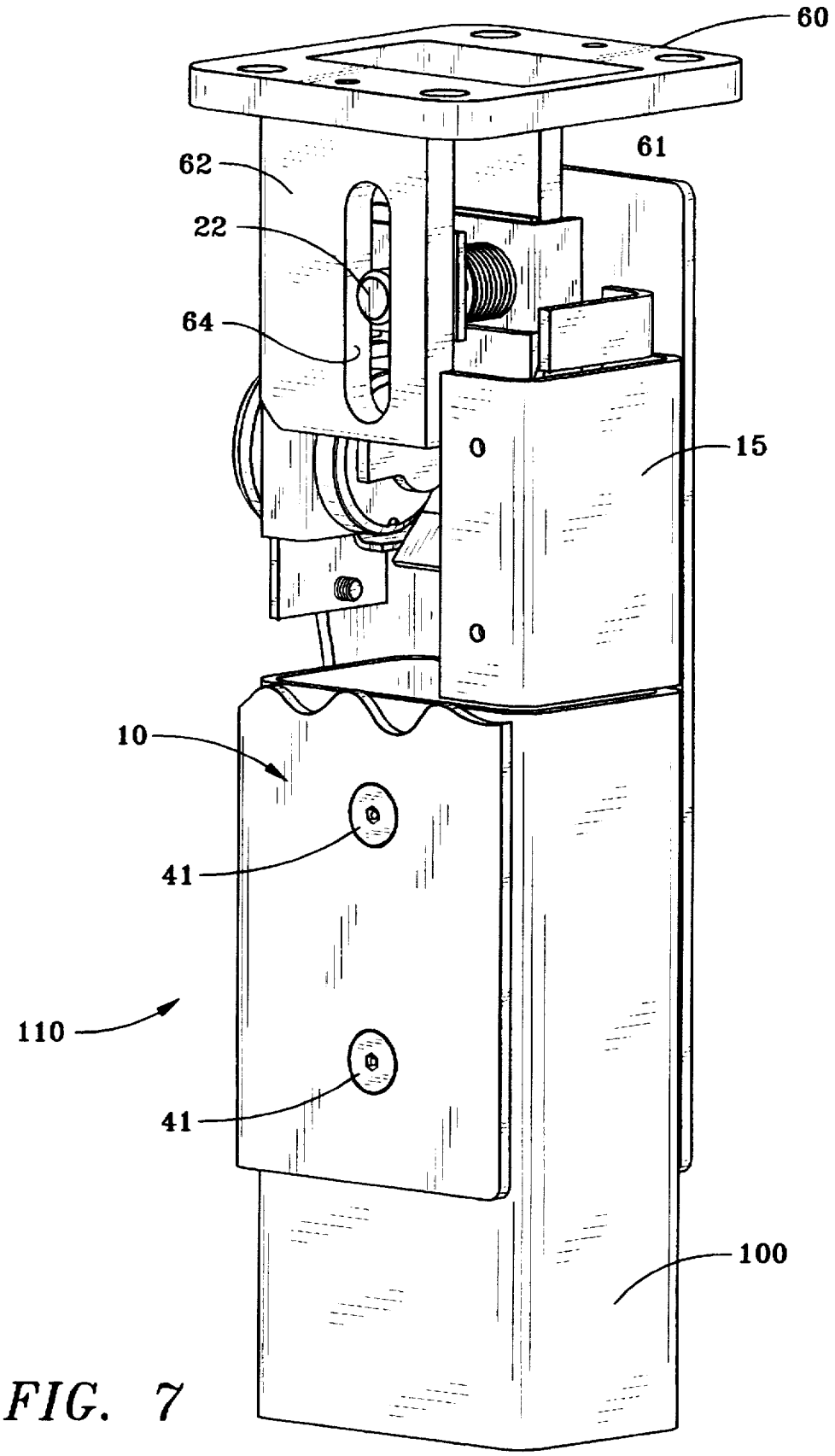
FIG. 7 is a schematic partially cutaway perspective view of the fire-rated mullion assembly engaged with the top fitting after exposure to a fire.

The partially cut-away mullion head 10 shown in FIG. 3 reveals further details of its engagement with the top fitting 60 and the interposed fusible spacer 50. Spacer 50 (shown separately in FIG. 8) is a collar-like member overlaying the top fitting 60 and intermeshing with the mullion head 10 to form a strong rattle—free assembly when installed in a doorway. Primary wall 62 of top fitting 60 has a vertical slot 64 for receiving locking bolt 22 when the mullion is in the locked condition. Note that bolt 22 is near the bottom of slot 64 at ordinary temperatures and spacer 50 is in place. In the event of fire, the spacer 50 melts and, as the mullion grows due to thermal expansion, the bolt 22 travels upward in the slot 64 to maintain the locked condition without buckling the mullion. This condition is seen in FIG. 7. Note that the key cylinder cam 72 is turned out of engagement with locking bolt lever 20 when the bolt 22 is locked. The primary wall 62 of the top fitting 60 also has a beveled edge (not visible here) for allowing the bolt 22 to ramp up during installation to engage the slot 64 without using the key to draw the bolt back.

Figure 4:
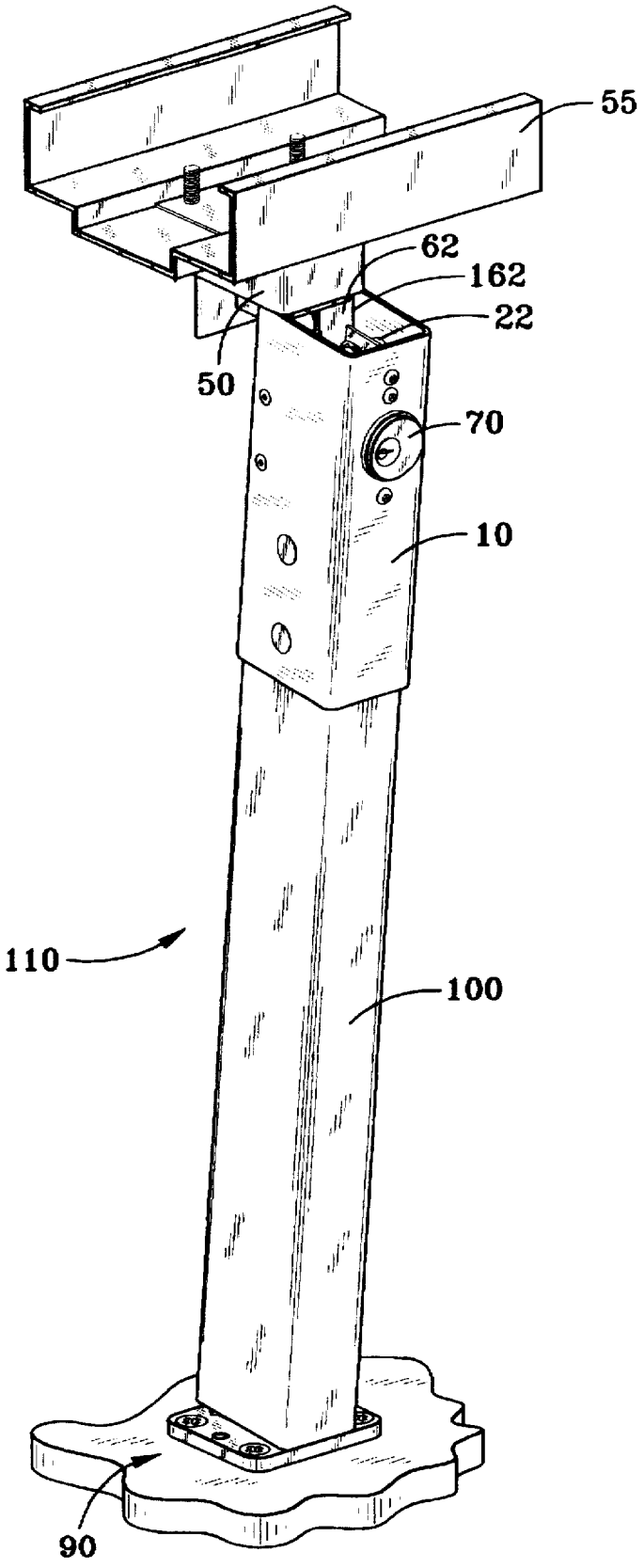
FIG. 4 is a schematic perspective view illustrating the installation of the fire-rated mullion assembly on the bottom fitting and the top fitting.

FIG. 4 schematically illustrates installation of the mullion assembly 110 in a doorway. The mullion tube 100 is placed over the bottom fitting 90, and the mullion assembly is pivoted into engagement with the top fitting and fusible spacer 50 mounted to the lintel 55 of the door frame. The bolt 22 ramps up bevel 162 of the primary face 62 of the top fitting and snaps into engagement with the slot to lock the mullion in place.

Figure 5:
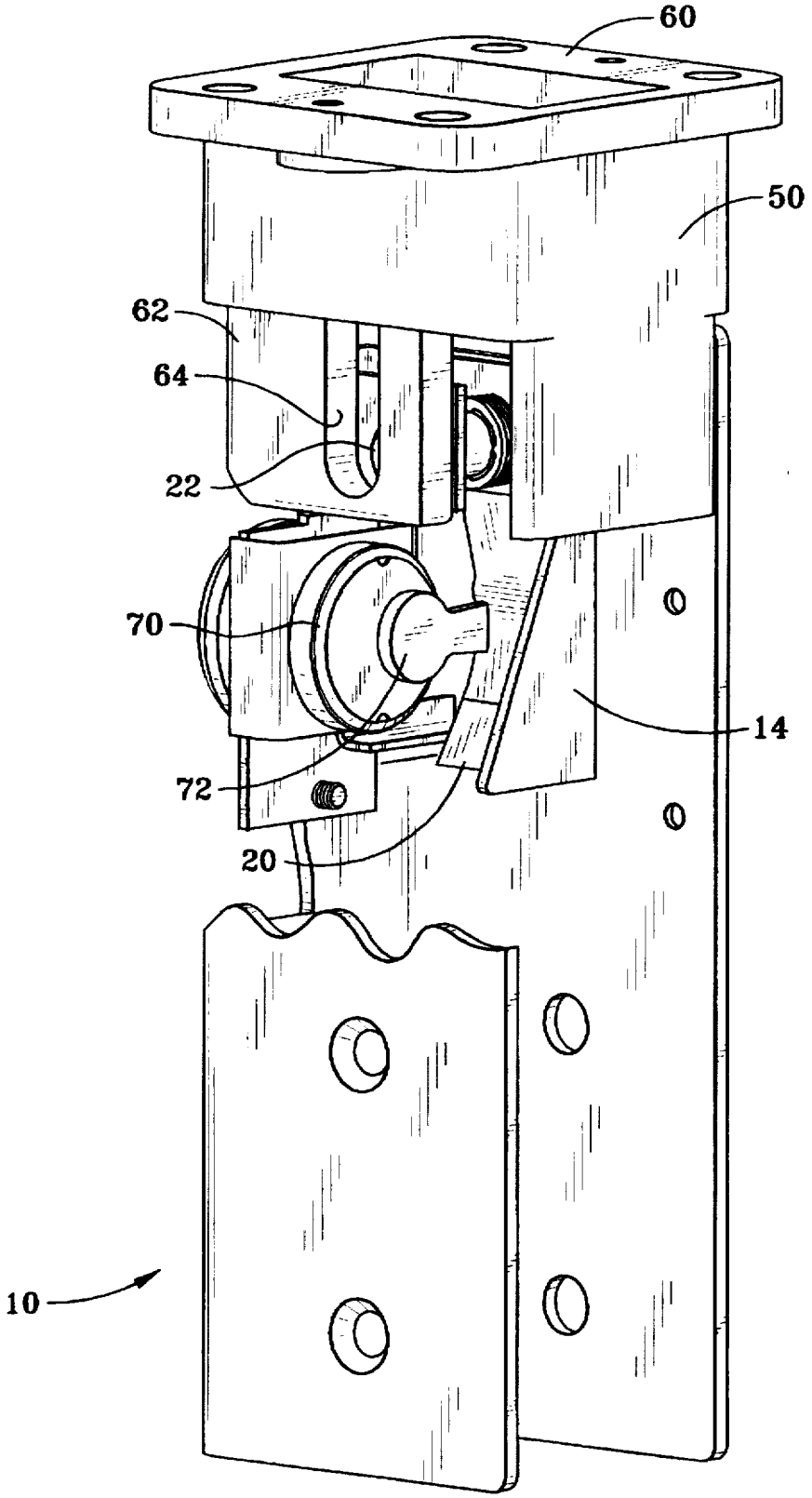
FIG. 5 is a schematic partially cutaway perspective view of the mullion head engaged with the top fitting with the key cylinder in the unlocked position.

FIG. 5 is identical to FIG. 3 in all respects, except that it shows the bolt 22 in the unlocked or retracted state. Here, the key cylinder cam 72 is turned to depress the locking bolt lever 20 and withdraw the bolt 22 from the slot 64. This is a necessary step for removing the mullion assembly and is also preferred for installation to reduce wear and tear on the components.

Figure 6:
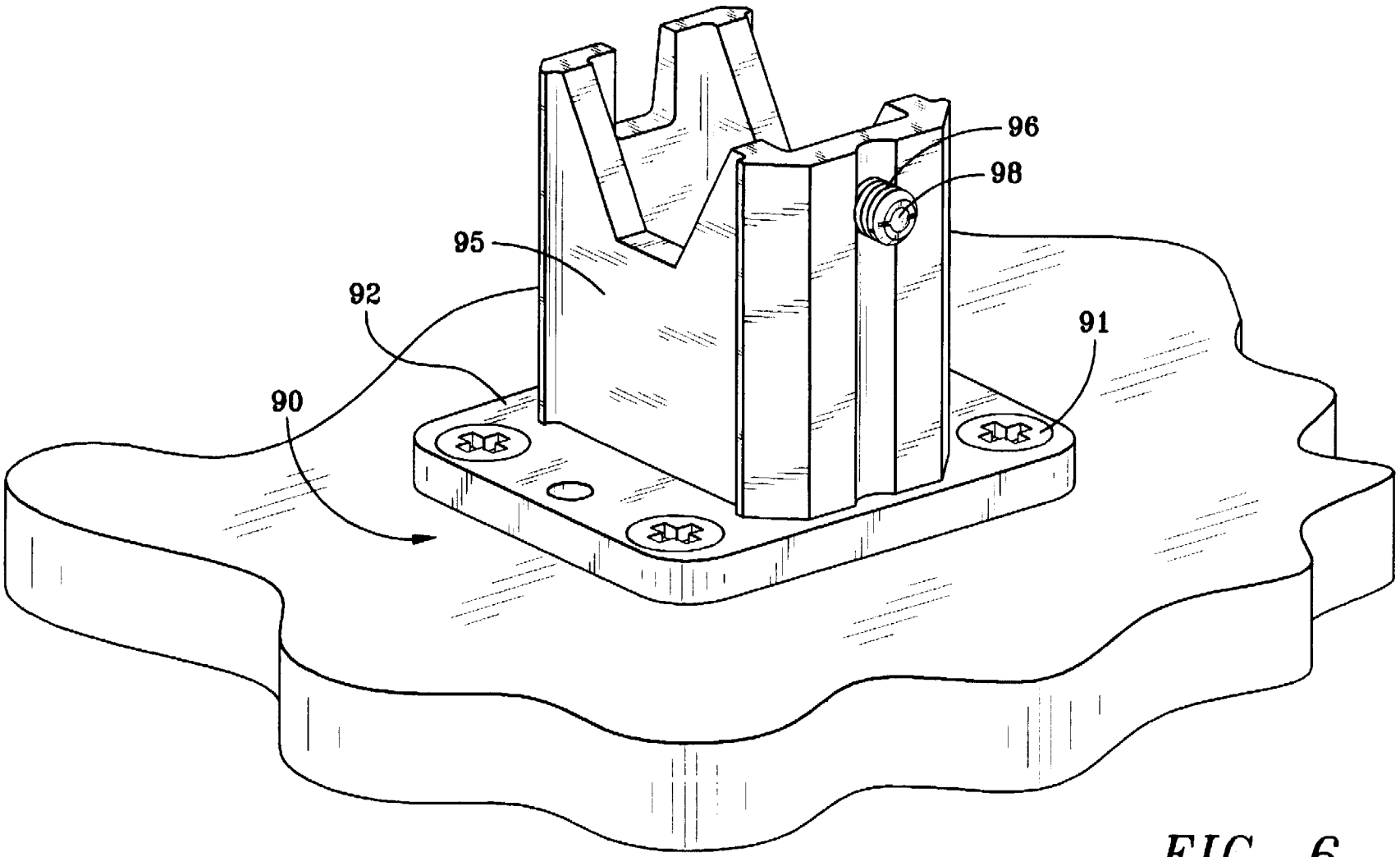
FIG. 6 is a perspective view of the bottom fitting.

The bottom fitting assembly 90 (FIG. 6) is shown mounted with fasteners 91 through a flange 92 to the bottom of a doorway (shown in fragmentary view) which may be a floor or a door sill member. An upwardly projecting portion 95 of the fitting is designed to fit inside the mullion tube. To ensure a rattle-free installation while still permitting some tilting during installation of the mullion tube, a threaded ball plunger 96 having a spring loaded ball 98 is adjustably installed in the upwardly projecting portion 95 of the bottom fitting assembly 90. Thus, when the mullion tube is vertical, the spring loaded ball 98 in its plunger 96 maintains a spring loaded pressure on the tube to prevent rattling.

FIG. 7 is a partially cutaway view of an installed mullion assembly according to a preferred embodiment of the invention after exposure to a fire and while still hot from the exposure. The spacer has melted away and is no longer seen, and the mullion assembly 110 has expanded so that the bolt 22 is about halfway up the slot 64 in the primary wall 62 of the top fitting 60. As a result of the expansion of the mullion assembly 110, it has grown to a point where the secondary wall 61 of the top fitting lies behind the locking bolt lever (not numbered here) and prevents retraction of the locking bolt 22. The rear cover plate 15 of the mullion head 10 is clearly seen in this Figure.

Figure 8:
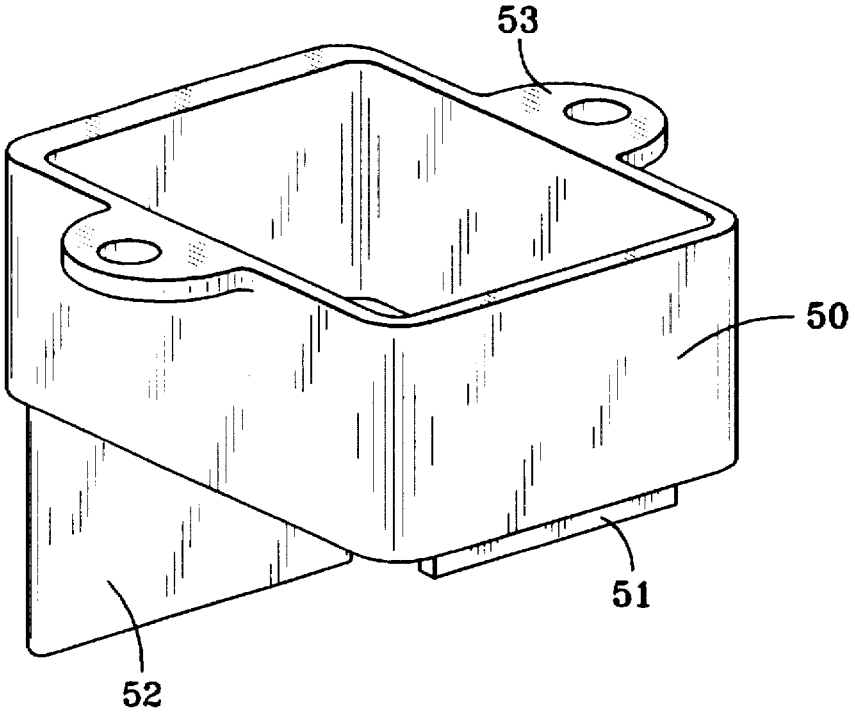
FIG. 8 is a top perspective view of the fusible spacer showing its simple sleeve-like form.

The fusible spacer 50 is shown in FIG. 8. Ears 53 allow it to be mounted with the top fitting, front lip 51 provides an overlap with the wall of the mullion head, and rear wall 52 provides an overlap with the back cover of the mullion head. The size of the spacer is determined by the expected temperature rise in a fire and the physical properties of the mullion material. For example, for a mullion material having a coefficient of thermal expansion of "X" micro-millimeters/millimeter degree Celsius, a length of 2000 millimeters, and an expected temperature rise of 1000 degrees Celsius; the mullion would be expected to expand by 2 "X" millimeters.

Figure 9:
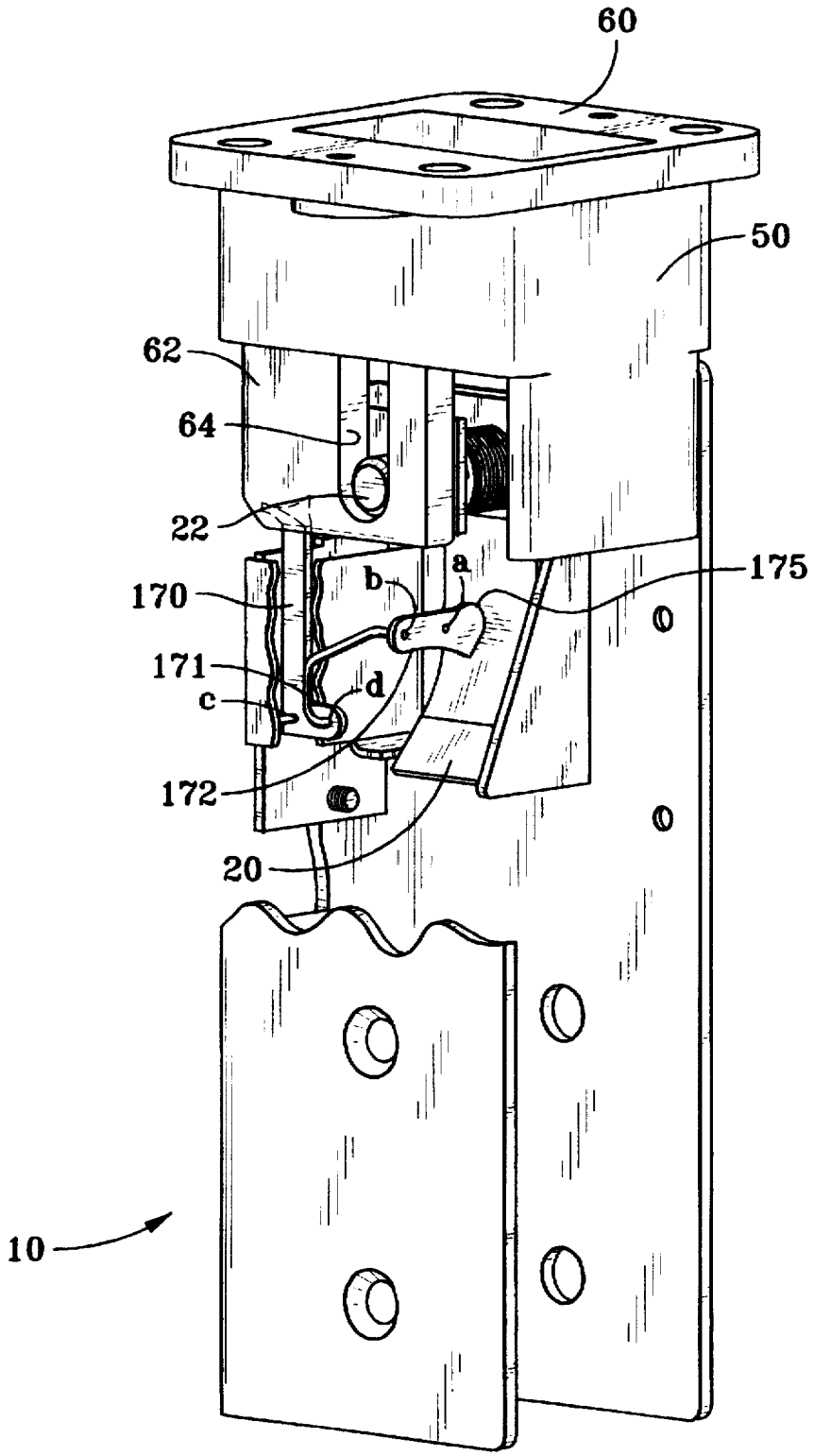
FIG. 9 is a schematic partially cut-away view as in FIG. 3 showing a flush bolt lever for operating the locking bolt.

The preferred embodiment has been described with a fusible spacer and a mortise key cylinder lock. However, it should be noted that in secure locations the lock may not be necessary in all applications. In such cases, a simple flush bolt mechanism, as shown in FIG. 9, will suffice for holding the mullion in place. Flush bolt 170 has a pivot c about which it rotates when pulled outwardly. This causes link 171, which is pivoted at d in flush bolt 170, to rotate cam 172, through its link pivot b, about pivot a to bring cam lobe 175 into engagement with bolt lever 20 and to withdraw bolt 22 from its engagement in slot 64 of primary face 62 of top fitting 60.

Figure 10:
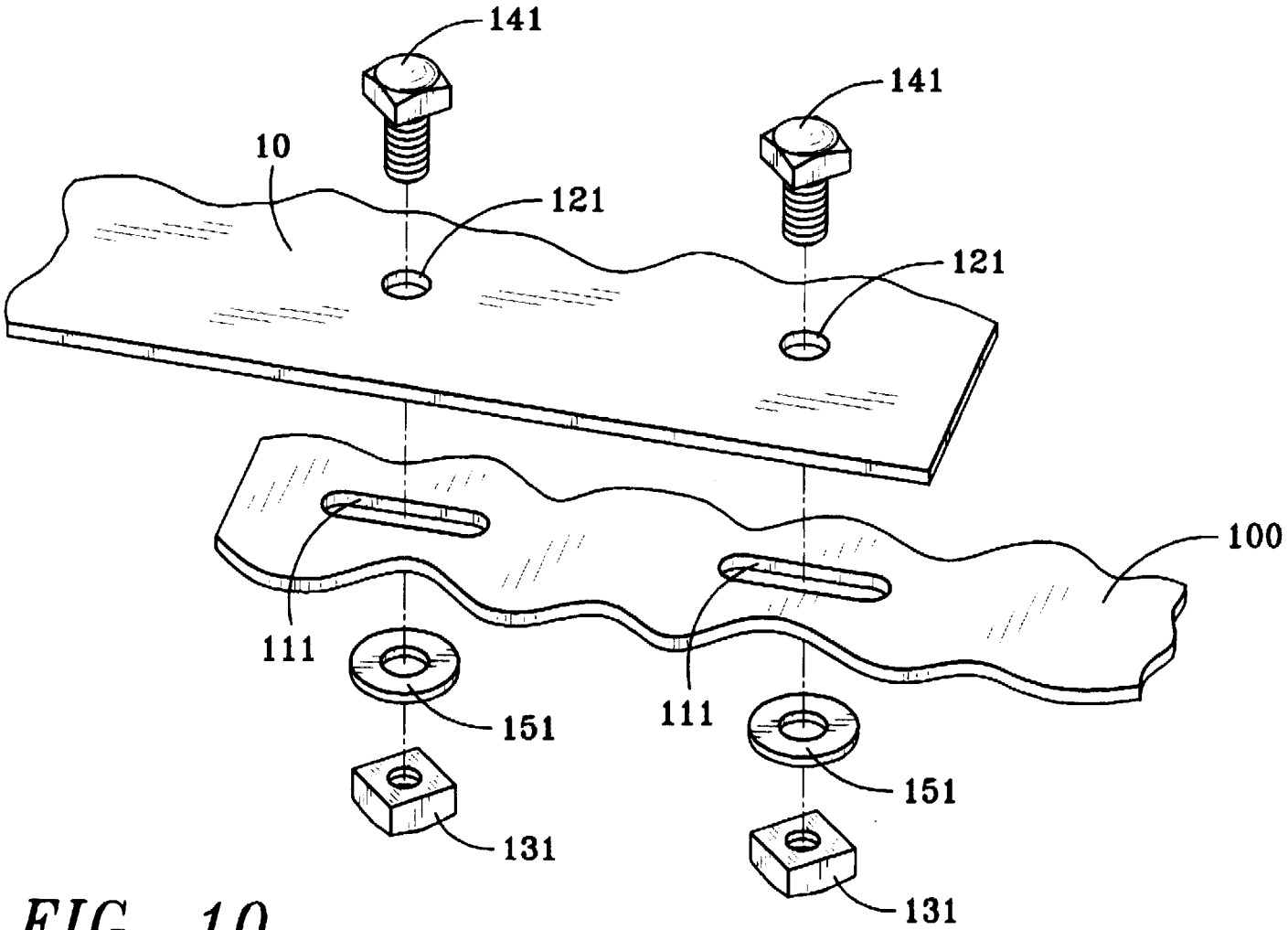
FIG. 10 is a schematic illustration of an overlapping joint with a temperature activated clamping force release.

Also, the expansion accommodation may be provided with overlapping joints, slotted fastener holes, and high expansion fasteners the clamping forces of which decrease with increasing temperature. Using standard fasteners with friction enhancing means such as adhesive interlayers or knurling of contacting faces of the overlapping joint members, and fusible shims or washers would also suffice. The schematic lap joint shown in FIG. 10 illustrates the physical layout of such an arrangement. The mullion head 10 has holes 121 for fasteners 141. The mullion tube 100 has slotted holes 111 for receiving the fasteners 141. Behind the mullion tube 100 are fusible washer shims 151 which are clamped between the nuts 131 and the mullion tube 100 when the fasteners 141 are tightened in the nuts 131. Upon heating in a fire, the washer shims 151 melt and release the clamping force of the fasteners to allow the bolts to slide in the slotted holes 111 to accommodate thermal expansion of the mullion assembly.

The novel features of this invention can readily be extended, in retrofit kit form, to standard mullions by merely removing the mullion, changing the top fitting to conform to the fitting disclosed herein, proving a mullion head as described, cutting-off a portion of the mullion to allow for installation of the mullion head and fusible spacer, and changing the bottom fitting only if necessary.

What is claimed is:

1. A fire-rated removable mullion assembly mounting in a doorway having a frame with a top, a bottom, and two sides, comprising:

a top fitting mounted to the top of the door frame;

a bottom fitting assembly mounted to the bottom of the door frame;

a mullion head having means for detachably engaging said top fitting;

a mullion tube having means for mounting between said mullion head and said bottom fitting assembly; and means for accommodating thermal expansion of said mullion assembly in case of fire to resist warping of said mullion assembly, the means for accommodating thermal expansion of said mullion assembly to resist warping of said mullion assembly comprising a fusible spacer mounted between two components of a group of components consisting of said top fitting, said mullion head and said mullion tube.

2. The fire rated removable mullion assembly according to claim 1, wherein the means for detachably engaging said top fitting comprises a locking bolt assembly.

3. The fire-rated removable mullion assembly according to claim 2, further comprising:

means for operating said locking bolt assembly.

4. The fire-rated removable mullion assembly according to claim 3, wherein the means for operating said locking bolt assembly comprises a mortise lock key cylinder.

5. The fire-rated removable mullion assembly according to claim 3, wherein the means for operating said locking bolt assembly comprises a flush bolt cam and lever mechanism.

6. A fire-rated removable mullion assembly mounted in a doorway having a frame with a top, a bottom, and two sides, comprising:

a top fitting mounted to the top of the door frame;

a bottom fitting assembly mounted to the bottom of the door frame;

a mullion head having means for detachably engaging said top fitting;

a mullion tube having means for mounting between said mullion head and said bottom fitting assembly; and means for accommodating thermal expansion of said mullion assembly in case of fire to resist warping of said mullion assembly, the means for accommodating thermal expansion of said mullion assembly to resist warping of said assembly comprising a fusible spacer mounted between said mullion head and said top fitting assembly.

7. A fire-rated removable mullion assembly mounted in a doorway having a frame with a top, a bottom, and two sides, comprising:

a top fitting mounted to the top of the door frame;

a bottom fitting assembly mounted to the bottom of the door frame;

a mullion head having means for detachably engaging said top fitting;

a mullion tube having means for mounting between said mullion head and said bottom fitting assembly; and means for accommodating thermal expansion of said mullion assembly in case of fire to resist warping of said mullion assembly, the means for accommodating thermal expansion of said mullion assembly to resist warping of said mullion assembly comprising at least one overlapping joint between the mullion head, the mullion tube, and the top fitting; said overlapping joint having means for releasing clamping force when exposed to fire.

8. A conversion kit converting a standard mullion in a doorway, having a frame with a top, a bottom, and two sides, to a removable fire-rated mullion assembly, said conversion kit comprising the following separable parts:

a top fitting mounted to the top of the door frame;

a bottom fitting assembly mounted to the bottom of the door frame;

a mullion head having means for detachably engaging said top fitting;

a mullion tube having means for mounting between said mullion head and said bottom fitting assembly; and means for accommodating thermal expansion of said mullion assembly in case of fire to resist warping of said mullion assembly, the means for accommodating thermal expansion of said mullion assembly to resist warping of said mullion assembly comprising a fusible spacer mounted between two components of a group of components consisting of said top fitting, said mullion head and said mullion tube.

9. A method for converting a standard mullion in a doorway, having a frame with a top, a bottom, and two sides, to a removable fire-rated mullion, comprising the following steps:

providing a conversion kit for converting a standard mullion to a removable fire-rated mullion;

removing the standard mullion, its top fitting, and its bottom fitting;

installing a top fitting and a bottom fitting from said conversion kit;

mounting a fusible spacer from said conversion kit to a bottom side of said top fitting;

determining the length of mullion assembly required for the doorway with the top and bottom fittings installed;

measuring a mullion head in said conversion kit to determine the length of mullion tube required to be connected to said mullion head to yield a mullion assembly of a length determined in the previous step;

if the standard mullion removed is serviceable, cutting it to the required length, drilling fastener holes for attaching the mullion head, and attaching the mullion head to the mullion tube to make a mullion assembly; and installing the mullion assembly by setting the mullion tube on the bottom fitting and rotating the mullion assembly into latching engagement with the top fitting with the fusible spacer between a flange of the top fitting and the mullion assembly.

10. A fire-rated removable mullion assembly mounted in a doorway having a frame with a top, a bottom, and two sides, comprising:

a top fitting mounted to the top of the door frame;

a bottom fitting assembly mounted to the bottom of the door frame;

a mullion head having means for detachably engaging said top fitting;

a mullion tube having means for mounting between said mullion head and said bottom fitting assembly; and means for accommodating thermal expansion of said mullion assembly in case of fire to resist warping of said mullion assembly, the means for accommodating thermal expansion of said mullion assembly to resist warping of said assembly comprising an overlapping joint between said mullion head and said mullion tube, said overlapping joint having means for applying a clamping force to said joint and releasing said clamping force when exposed to fire.

11. A fire-rated removable mullion assembly mounting in a doorway having a frame with a top, a bottom, and two sides, comprising:

a top fitting mounted to the top of the door frame;

a bottom fitting assembly mounting to the bottom of the door frame;

a mullion head having means for detachably engaging said top fitting, the means for detachably engaging said top fitting comprises a locking bolt assembly;

a mullion tube having means for mounting between said mullion head and said bottom fitting assembly; and means for accommodating thermal expansion of said mullion assembly in case of fire to resist warping of said mullion assembly, said means for accommodating thermal expansion comprising a fusible spacer disposed between said top fitting and said mullion head; and, said top fitting comprises a mounting plate and primary and secondary walls extending downwardly from said mounting plate; the primary wall having a vertical slot therein into which a locking bolt of said locking bolt assembly extends, said locking bolt moving upwardly in said slot due to thermal expansion of the mullion assembly when said fusible spacer fuses due to heat, and said secondary wall having a length such that it blocks movement of said locking bolt when said locking bolt has moved upwardly in said slot.

* * * * *